US005778536A

United States Patent [19]

West

[11] Patent Number: 5,778,536

[45] Date of Patent: Jul. 14, 1998

[54] COMBINATION SLOTTING, SLITTING AND SCORING TOOL FOR MAKING CORRUGATED BOXES

[76] Inventor: Charles Howard Allen West, 7812 Valrie La., Riverview, Fla. 33569

[21] Appl. No.: 702,953

[22] Filed: Aug. 26, 1996

[51] Int. Cl.[6] ..... B26B 1/08; B26B 11/00

[52] U.S. Cl. ..... 30/123; 30/143; 30/152; 30/299; 30/304; 30/317; 30/320; 30/365

[58] Field of Search ..... 30/1, 2, 123, 162, 30/163, 164, 151, 152, 299, 304, 305, 307, 314, 317, 319, 358, 359, 365, 366, 367, 368, 353, 142, 143, 320; 7/156, 167

[56] References Cited

U.S. PATENT DOCUMENTS

| | | | |
|---|---|---|---|
| 791,623 | 6/1905 | Holmes | 30/353 X |
| 2,258,448 | 10/1941 | Gesell | 30/304 X |
| 2,510,530 | 6/1950 | Telschow | 30/2 X |
| 2,737,069 | 3/1956 | Weindel, Jr. | 30/162 X |
| 2,753,105 | 7/1956 | Werner et al. | 30/2 X |
| 4,578,865 | 4/1986 | Keller | 30/304 |
| 4,783,867 | 11/1988 | Tsao | 30/123 X |
| 4,796,361 | 1/1989 | Neal | 30/367 X |
| 4,974,320 | 12/1990 | Pelletier | 30/123 |
| 5,396,704 | 3/1995 | Fiala et al. | 30/299 |
| 5,513,405 | 5/1996 | Bradbury, Jr. et al. | 30/123 X |

*Primary Examiner*—Clark F. Dexter

[57] ABSTRACT

An apparatus for slitting, scoring, and slotting paperboard and the like for the creation of paperboard boxes and other shapes. The apparatus comprises a handle having a built-in three bladed slotting knife that is retractable and quickly allows a worker to create a slot. A retractable slitting knife and a scoring wheel are also affixed to the handle.

9 Claims, 4 Drawing Sheets

COMBINATION SLOTTING, SLITTING AND SCORING TOOL FOR MAKING CORRUGATED BOXES

BACKGROUND

1. Field of the Invention

This invention relates to a tool for making corrugated boxes. More specifically, this invention relates to a tool for making slots, slits, and scoring lines on corrugated paper boards for the creation of boxes and other useful shapes.

2. Description of the Prior Art

Boxmakers, shipping departments, and small business owners have a regular need to manually construct or modify small quantities of folding corrugated paper containers (cardboard boxes). The three primary aspects of constructing or modifying a box are slitting (making cuts in the board), scoring (making linear creases without tearing the paper to fold the board evenly) and slotting (cutting closely spaced parallel strips along the scores to allow the flaps to join easily without bulging). To slit the board, a common utility razor knife is used. A score is a crease pressed into the board to position and accommodate folding. To score the board, a variety of improvised tools are used including just turning the razor knife over and drawing the dull edge of the knife along the score line. These improvised tools usually cut the paper to allow the score to fold rather than just creasing the fold line.

Slotting is the most basic form of cutting needed to make most box styles. When the finished blank is folded along its score line, the distance around the inside is less than the outside measurement. The slot is needed at each corner to allow for this difference and permit folding of the flaps. To manually create a slot, two parallel slits are made and the middle portion of paper is just cut away. Most people just use a slit rather than make the two parallel cuts to form a strip which then has to be cut-out. Just using a slit will create bulging and unevenness when the corners are folded together and bulging and unevenness is increased with the thickness of the corrugated paper being used.

One problem with using single straight blade to create a slot is that single straight blades need to be used in conjunction with a straight edge. Single straight blades tend to cut in non-linear or crooked lines if they are not used in conjunction with a straight edge device.

There have been several approaches for tools used to create corrugated boxes and the like, in U.S. Pat. No. 5,375,492, "A stack of folded and glued corrugated paperboard boxes is slit in unison with a thin cutting blade having a linear cutting edge disposed parallel to the plane of the boxes and moved through the stack in an angular direction to slit essentially one box at a time. The stack is squared before slitting in the aligned box edges, however, the force of the blade on the stack as it moves therethrough holds the receding stack together such that the cut halves of each box may part laterally as the blade passes therethrough to avoid any crushing of the corrugated paperboard media."

In U.S. Pat. No. 5,340,301, "A process and apparatus for rapidly and accurately forming corrugated substructures of complex shapes utilizing composite material a plurality of movable elongated ribs are positioned on a base plate for lateral movement between an open position at which all of the ribs are physically separated and a closed position at which each of the ribs is engaged with its adjacent rib or ribs. The ribs are so formed that when they collectively assume the closed position, upper regions of the ribs remain spaced apart and define longitudinally extending channels. A pre-cut sheet of composite pre-preg material is laid over the ribs so as to be coextensive with them. The ribs are then moved together mechanically or by means of vacuum drawing the sheet material into the channel or both. With the aid of elongated tooling bars placed onto each outer surface of the sheet material and aligned with successive channels, the sheet material is drawn into conforming relationship with the ribs. A frame fixture is then attached to encompass the outer periphery of the ribs to releasably hold the ribs in the rib's collectively closed positions. So supported, the sheet material can be removed from the base plate, then cured so as to retain the corrugated shape imparted by the ribs acting collectively."

While some of the prior art may contain some similarities relating to the present invention, none of them teach, suggest or include all of the advantages and unique features as the corrugated box making tool as the invention disclosed herein.

For the foregoing reasons, there is a need for a tool that can easily make scoring lines, slits, and slots on corrugated paper boards to created boxes in a quick and easy fashion.

SUMMARY

The present invention is directed towards an apparatus for creating geometrical shapes out of corrugated paperboard material by creating scoring lines, slots, and slits. The invention comprises a handle body with a slot knife affixed to said handle. The slot knife consists of three blades, two of them arranged in a parallel fashion, and the other in a downward perpendicular relation. The handle contains a cavity allowing the slot knife to retract into a safe position. At the other end of the handle is a retractable slit knife and a scoring wheel.

Accordingly, it is an object of this invention to provide a tool that can create slots, slits and scoring lines quickly and easily.

Another object of this invention is to provide a slot knife that can quickly create slot in corrugated paperboards. Also, a slot knife that can cut in a straight fashion without the need for straight edge devices.

Other objects and a fuller understanding of the invention will become apparent from reading the following detailed description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

Four sheets of drawings are furnished, sheet one contains FIG. 1, sheet two contains FIG. 2, sheet three contains FIG. 3, and sheet four contains FIG. 4.

DESCRIPTION OF THE PREFERRED EMBODIMENTS

Figure 1:
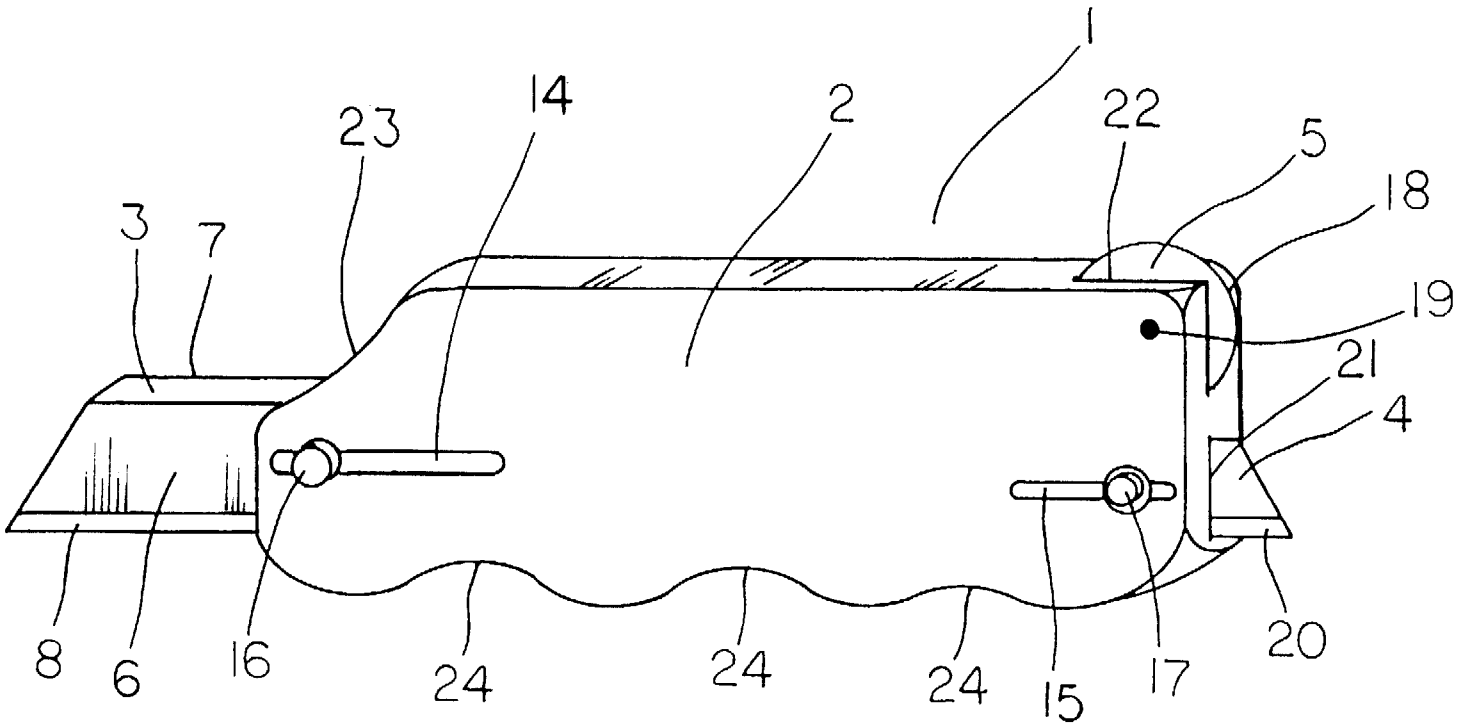
FIG. 1 is a perspective view of the invention showing the slot knife, the slit knife, and the scoring wheel.

Referring now to FIG. 1, an apparatus for slitting, slotting, and scoring corrugated boards for purposes of making boxes is referred to generally by reference numeral 1. The apparatus 1 is made up primarily of a handle body 2, a slotting knife 3, a slitting knife 4, and a scoring wheel 5.

Still referring to FIG. 1, we see the apparatus 1 having the slot knife 3, the slit knife 4, and the scoring wheel 5 in their extended position. The slot knife 3 is extended and retracted by locking nut 16 and slot 14 as well as a built-in cavity not shown in FIG. 1. The slit knife 4 is extended and retracted by locking nut 17 and slot 15 as well as cavity 21. The slit knife 4, which includes a single blade with keen edge 20, is allowed to slide in and out of cavity 21 via locking nut 17 and slot 15. Finger grips 24 are located at the bottom portion of the apparatus 1 as well as a thumb grip 23 located at the upper region adjacent to the slot knife 3. It is important that a person have a good grip on the apparatus 1 during operation, otherwise, the knives 3 and 4 could possibly cut a worker if the handle 2 were to slip out of his or her hands.

At the upper corner portion of the apparatus 1 is a scoring wheel 5 having a dull edge 18 around its perimeter. The scoring wheel is partially embedded into the handle body 2 via slot 22. Also, the scoring wheel 5 is allowed to rotated on an axis via bolt 19. It should be noted that the scoring wheel 5 could also be located at a variety of other locations on the handle body 2. Unlike the slot knife 3 and slit knife 4, the scoring wheel 5 has been chosen not to be retractable because the dull edge 18 does not pose a threat of injury to the worker while being exposed.

Figure 2:
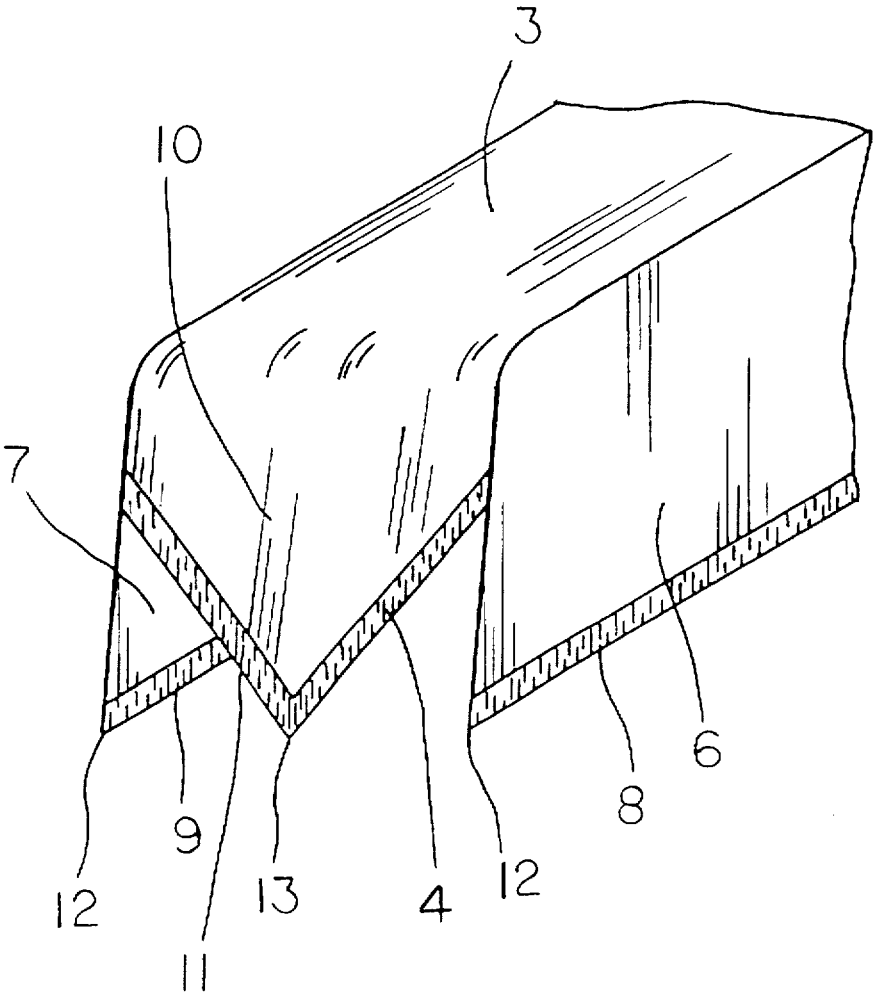
FIG. 2 is an exploded perspective view of the slot knife.

In FIG. 2, the slot knife 3 is shown with first blade 6 parallel to the second blade 7 and separated a given distance apart by third blade 10. Normally, the separation distance between blades 6 and 7 is about a quarter of an inch. This distance allows for the corrugated paper boards to fold easily at the corners when making boxes requiring high degree folds. Note, the quarter inch separation distance will suffice for a variety of thicknesses of corrugated paper boards and still allow for easy high degree folds. However, as a general rule, the thicker the corrugated paper boards become, the greater the distance between the first and second slot blades should be. Each of the blades 6, 7, and 10 have keen edges 8, 9, and 11 respectively at the bottom portion of the blades. At the front region of the slot knife 3 are three sharp points 12 and 13 that are used to first be inserted into the paperboard boxes at site 33. The sharp points 12 and 13 are inserted into the paperboards until the entire keen edge 11 of knife 10 has cut into the paperboard. The blade 3 is then pulled along the score line 31 until it reaches the end.

Figure 4:
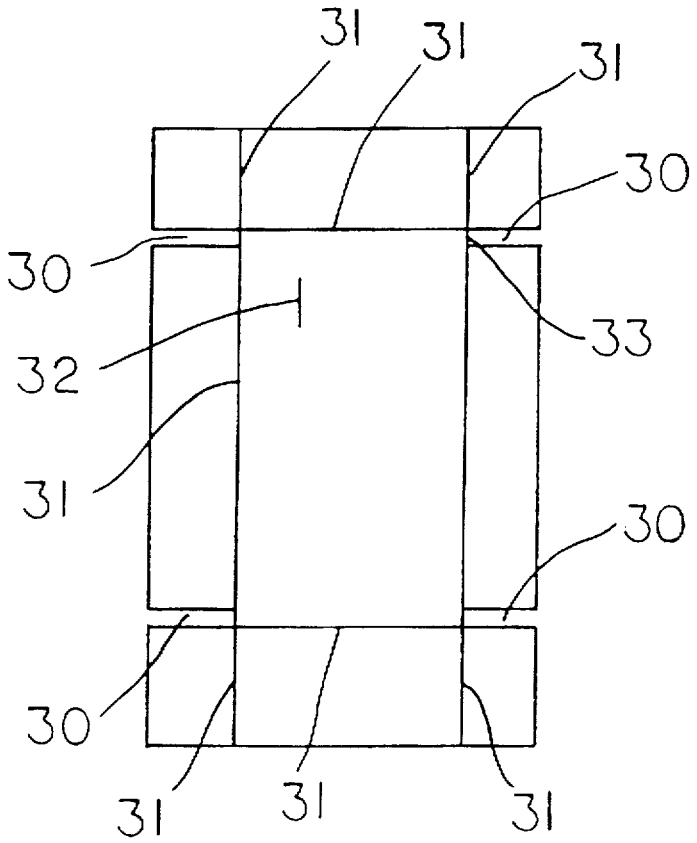
FIG. 4 is a top view of a piece of corrugated paper board having scoring lines, slits, and slots.

Referring to FIG. 4, during operation creating a slot 30, points of blades 6, 7, and 10 are first inserted into the corrugated paperboard at the site 33 until the blade 10 has fully entered the corrugated paperboard. Next, the knife 3 is then pulled in the direction in which the slot 30 is to be made. The created slot 30 will have a width equal to the distance the blades 6 and 7 are separated. To create a score line 31, a straight edge device is place along the location in which the score line is to be created. Next, the scoring wheel 5 is then pressed against the paperboard and rolled along side the straight edge device thereby creating the score line 31.

Figure 3:
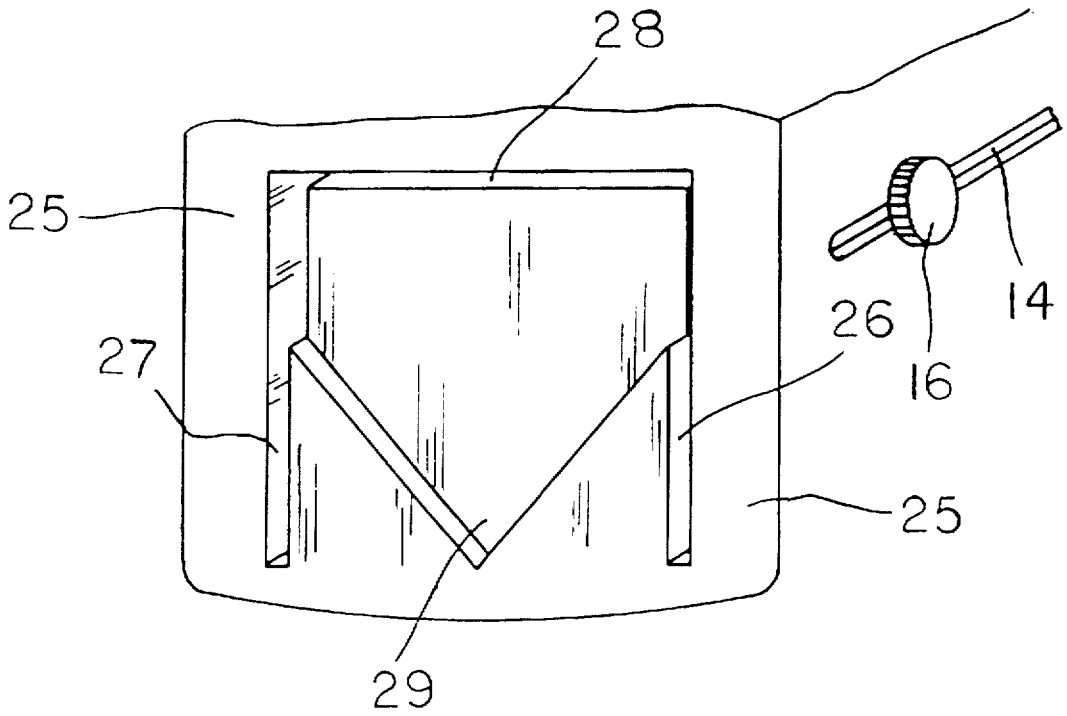
FIG. 3 is an exploded perspective view of the front side of the invention showing a cavity to house the slot knife.

Referring to FIG. 3, we see the front side 25 of the handle 2 where a cavity is used to house the sharp keen edges 11, 8, and 9 of blades 10, 6, and 7 respectively. Slots 26 and 27 allow parallel blades 6 and 7 to retract into and be concealed by handle 2 and slot 28 allows the upper portion of the knife 3 to slide therein. Cavity 29 is shown embedded a given distance into the handle 2 such that when the knife 3 is fully retracted, the sharp point 13 and keen edge 11 of blade 10 is safely tucked away from the worker's hands.

Accordingly, a very unique, attractive, and convenient apparatus is provided for slotting, slitting, and scoring lines on corrugated paperboards for purposes of creating cardboard boxes and the like.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A cutting device for creating geometrical shapes out of corrugated materials comprising:

(a) a handle;

(b) a slot cutting knife affixed to said handle, said slot cutting knife having a first cutting blade with a substantially straight keen edge, a second cutting blade with a substantially straight keen edge, the keen edge of said second cutting blade being substantially parallel to the keen edge of said first cutting blade, said first and second blades each having a front end, said slot cutting knife further including a third cutting blade extending between said first and second cutting blades in a transverse relation, said third cutting blade having two ends and being affixed at each end thereof to the front ends of said first and second cutting blades, respectively, and said third cutting blade having a keen edge that extends in a substantially V-shape between said two ends; and (c) a scoring wheel rotatably affixed to said handle.

2. An apparatus as set forth in claim 1 wherein said handle has a cavity therein and said slot cutting knife is slidably mounted in said cavity such that said slot cutting knife can be retracted into said handle.

3. An apparatus as set forth in claim 1 wherein said handle has a thumb grip located at a top side of said handle, and finger grips located at a bottom side of said handle.

4. An apparatus as set forth in claim 1 wherein said apparatus further comprises a slit cutting blade affixed to said handle.

5. An apparatus as set forth in claim 4 wherein said handle has a cavity therein and said slit cutting blade is slidably mounted in said cavity such that said slit cutting blade can be retracted into said handle.

6. A cutting device for creating geometrical shapes out of corrugated materials comprising:

(a) a handle;

(b) a slot cutting knife affixed to said handle, said slot cutting knife having a first cutting blade with a substantially straight keen edge, a second cutting blade with a substantially straight keen edge, the keen edge of said second cutting blade being substantially parallel to the keen edge of said first cutting blade, said first and second blades each having a front end, said slot cutting knife further including a third cutting blade extending between said first and second cutting blades in a transverse relation, said third cutting blade having two ends and being affixed at each end thereof to the front ends of said first and second cutting blades, respectively, and said third cutting blade having a keen edge that extends in a substantially V-shape between said two ends; and (c) a slit cutting knife affixed to said handle, wherein said handle has a cavity therein and said slit cutting knife is slidably mounted in said cavity such that said slit cutting knife can be retracted into said handle.

7. An apparatus as set forth in claim 6 wherein said handle has a thumb grip located at a top side of said handle, and finger grips located at a bottom side of said handle.

8. A cutting device for creating geometrical shapes out of corrugated materials comprising:

(a) a handle, said handle having a length-wise axis;

(b) a slot cutting knife affixed to said handle, said slot cutting knife having a first cutting blade with a substantially straight keen edge, a second cutting blade with a substantially straight keen edge, the keen edge of said second cutting blade being substantially parallel to the keen edge of said first cutting blade, said first and second blades each having a front end, said slot cutting knife further including a third cutting blade extending between said first and second cutting blades in a transverse relation, said third cutting blade having two ends and being affixed at each end thereof to the front ends of said first and second cutting blades, respectively, and said third cutting blade having a keen edge that extend in a substantially V-shape between said two ends, said first and second cutting blades being positioned parallel to said length-wise axis of said handle; and (c) a scoring wheel rotatably affixed to said handle.

9. An apparatus as set forth in claim 8 wherein said handle has a cavity therein and said slot cutting knife is slidably mounted in said cavity such that said slot cutting knife can be retracted into said handle.

* * * * *